US006977491B1

(12) United States Patent
Caldwell et al.

(10) Patent No.: US 6,977,491 B1
(45) Date of Patent: Dec. 20, 2005

(54) CURRENT LIMITING VOLTAGE REGULATION CIRCUIT

(75) Inventors: Joshua William Caldwell, Tucson, AZ (US); Steven Ashley Martinez, Tucson, AZ (US)

(73) Assignee: National Semiconductor Corporation, Santa Clara, CA (US)

( * ) Notice: Subject to any disclaimer, the term of this patent is extended or adjusted under 35 U.S.C. 154(b) by 67 days.

(21) Appl. No.: 10/680,500

(22) Filed: Oct. 6, 2003

(51) Int. Cl.[7] ..... G05F 1/40
(52) U.S. Cl. ..... 323/282
(58) Field of Search ..... 323/274, 280, 323/281, 282, 284, 351

(56) References Cited

U.S. PATENT DOCUMENTS 4,008,418 A * 2/1977 Murphy ..... 361/18
5,550,700 A 8/1996 Moore et al. ..... 361/101
5,955,915 A 9/1999 Edwards ..... 327/541
6,069,950 A 5/2000 Knollman ..... 379/413
6,144,187 A 11/2000 Bryson ..... 320/137
6,285,177 B1 9/2001 Mallikarjunaswamy et al. ..... 323/315
6,333,623 B1 * 12/2001 Heisley et al. ..... 323/280
6,426,886 B1 7/2002 Goder ..... 363/56.1
6,559,623 B1 * 5/2003 Pardoen ..... 323/274
6,867,640 B2 * 3/2005 Scott et al. ..... 327/541
2005/0035749 A1 * 2/2005 Bo et al.

* cited by examiner

*Primary Examiner*—Adolf Berhane

(57) ABSTRACT

A current limiting circuit. The current limiting circuit includes a device coupled to an output node of the current limiting circuit. The device is responsive to magnitude of a signal at the output node. Moreover, the device has a first mode and a second mode, depending on the magnitude of the signal. The current limiting circuit also has a regulation component that regulates a voltage at the output node when the device is in the first mode. The current limiting circuit also has an element having a current that limits current at the output node when the device is in the second mode.

18 Claims, 3 Drawing Sheets

CURRENT LIMITING VOLTAGE REGULATION CIRCUIT

TECHNICAL FIELD

The present invention generally pertains to the field of electronic circuits. More particularly, embodiments of the present invention are related to limiting output current in a voltage regulation circuit.

BACKGROUND ART

Many electronic circuits have a need for limiting current. Voltage regulators and battery chargers are two examples of circuits needing current limit protection, although many other circuits also need current limit protection. Voltage regulators provide a substantially constant voltage over a range of load impedances. However, if the load impedance is relatively small, the voltage regulator must output a very large current to maintain the output voltage. Such a large current can lead to overheating and damage or destruction of the output transistor, as well as nearby components. Frequently it is impractical to provide a heat sink for the voltage regulator due to, for example, space or economic constraints and packaging constraints.

Thus, a need exists for a current limiting circuit for an electronic circuit. A still further need exists for a current limiting circuit that is compatible with and can be fabricated economically with existing semiconductor fabrication techniques.

SUMMARY

The present invention provides current limiting in a voltage regulation circuit. Embodiments of the present invention provide current limit protection circuits that are compatible with and can be fabricated economically with existing semiconductor fabrication techniques.

A current limiting voltage regulation circuit is disclosed. In one embodiment in accordance with the present invention, the circuit comprises a device coupled to an output node of the current limiting circuit. The device is responsive to magnitude of a signal at the output node. Moreover, the device has a first mode and a second mode depending on the magnitude of the signal. The current limiting circuit also has a regulation component coupled to the device and that regulates a voltage at the output node when the device is in the first mode. The current limiting circuit also has an element coupled to the device that has a current that limits current at the output node when the device is in the second mode.

In one embodiment, the current limiting voltage regulation circuit comprises an output transistor, an error amplifier, and first and second transistors. The error amplifier has one input that receives a reference voltage and another input that is coupled to the output transistor to receive a scaled version of a regulated output voltage. The first transistor is coupled between a control terminal of the output transistor and an output of the error amplifier. The first transistor is responsive to the magnitude of a signal at the output transistor, wherein the first transistor has a first mode and a second mode depending on the magnitude of the signal. The second transistor is coupled to the first transistor and the output transistor, wherein a current through the second transistor is mirrored in the output transistor if the first transistor is in the second mode. Moreover, the error amplifier regulates the regulated voltage if the first transistor is in the first mode.

Another embodiment of the present invention is a method of limiting current and regulating voltage. The method comprises sensing a signal at an output node. If the signal is below a pre-determined threshold, a voltage at the output node is regulated. If the signal is above the pre-determined threshold, a current at the output node is limited without regulating the voltage at the output node.

These and other advantages of the present invention will no doubt become obvious to those of ordinary skill in the art after having read the following detailed description of the preferred embodiments which are illustrated in the various drawing figures.

BRIEF DESCRIPTION OF THE DRAWINGS

The accompanying drawings, which are incorporated in and form a part of this specification, illustrate embodiments of the invention and, together with the description, serve to explain the principles of the invention.

BEST MODE FOR CARRYING OUT THE INVENTION

Reference will now be made in detail to the preferred embodiments of the invention, examples of which are illustrated in the accompanying drawings. While the invention will be described in conjunction with the preferred embodiments, it will be understood that they are not intended to limit the invention to these embodiments. On the contrary, the invention is intended to cover alternatives, modifications and equivalents, which may be included within the spirit and scope of the invention as defined by the appended claims. Furthermore, in the following detailed description of the present invention, numerous specific details are set forth in order to provide a thorough understanding of the present invention. However, it will be obvious to one of ordinary skill in the art that the present invention may be practiced without these specific details. In other instances, well-known methods, procedures, components, and circuits have not been described in detail as not to unnecessarily obscure aspects of the present invention.

Figure 1:
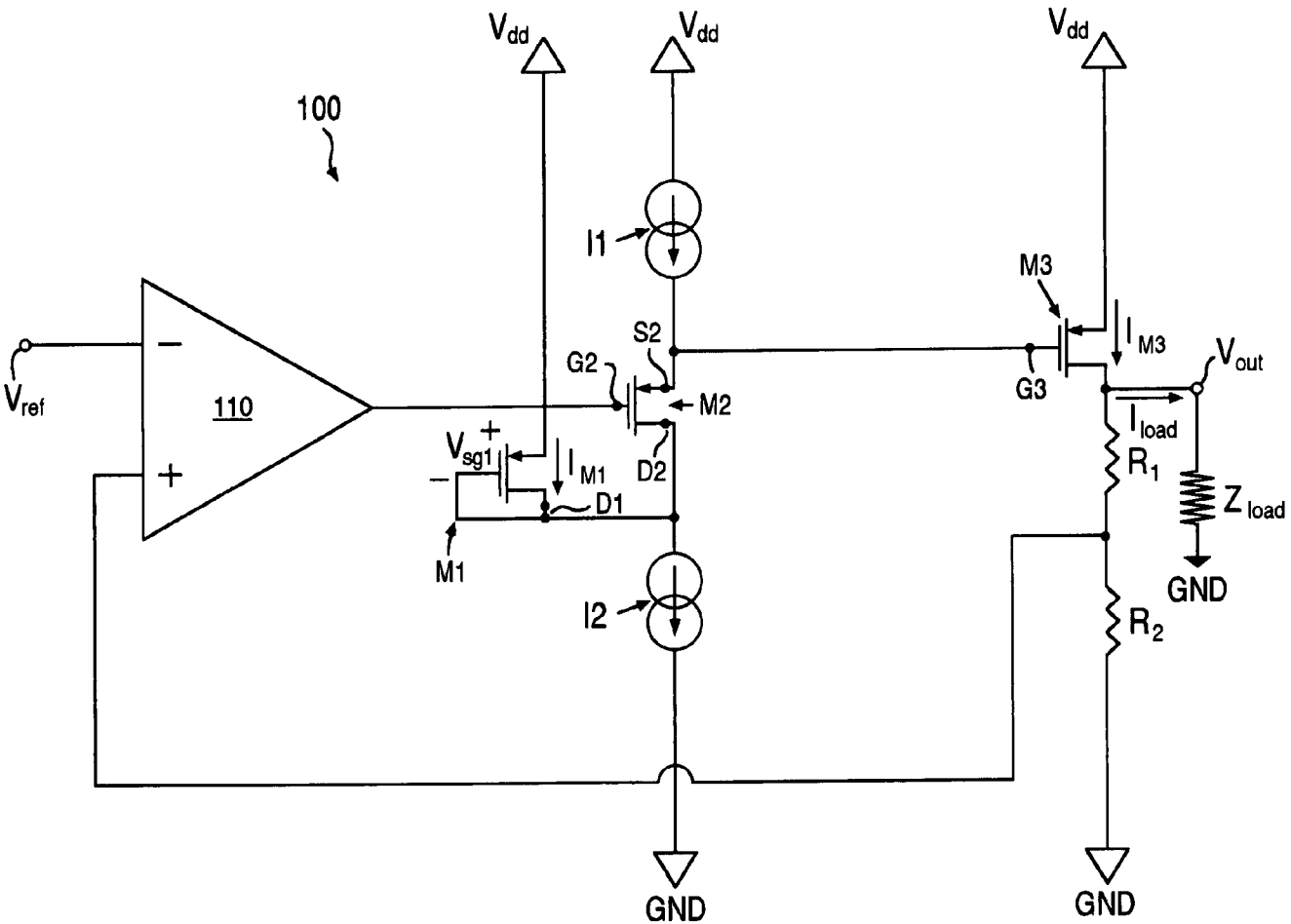
FIG. 1 is a schematic of a circuit for limiting current and regulating voltage, according to an embodiment of the present invention.

FIG. 1 is a schematic of a circuit for limiting current and regulating voltage, according to an embodiment of the present invention. The circuit 100 of FIG. 1 includes two operating modes. One of the modes may be termed a "voltage regulation" operating mode in which the error amplifier 110 regulates the output voltage $V_{out}$. The other operating mode may be termed a "current-limiting" mode in which an output current is limited. For example, the drain to source current of output transistor M3 is limited. In the current limiting mode, the error amplifier 110 may not regulate the output voltage $V_{out}$. Rather, the circuit 100 operates in a current regulation mode, in which a current (e.g., $I_{M1}$) is used to regulate and limit the output transistor current $IM_3$. The current limiting mode may be used as protection if, for example, the load impedance $Z_{load}$ is so low that the output transistor current $IM_3$ would be at an unsafe level without the current protection. Thus, the circuit 100 provides protection against short circuits, as well as low load impedance situations. The actual current that results in an unsafe power level could be virtually any level, depending on input voltage (Vdd), output voltage (Vout), construction of output transistor M3, and environment.

The circuit 100 comprises an error amplifier 110 that regulates the output voltage $V_{out}$, during a voltage regulation operating mode. The error amplifier 110 has a reference voltage $V_{ref}$ as an input to its negative input. Its positive input is coupled between output resistors R1 and R2. The output of the error amplifier 110 is coupled to the gate G3 of the output transistor M3 via transistor M2. Thus, the voltage regulation loop includes the transistor M2, which will be discussed in more detail below. Output resistor R2 is coupled to ground and output resistor R1 is coupled to the output transistor M3, such that the output voltage $V_{out}$ may be set relative to the reference voltage $V_{ref}$, based on the sizes of output resistors R1 and R2.

The transistor M2 may be referred to throughout this description as a range-limited buffer. The range-limited buffer transistor M2 is responsive to a signal at the output transistor M3. The signal at the output transistor M3 may be the output voltage $V_{out}$ or the drain to source current IM3 of the output transistor M3. The range-limited buffer transistor M2 has two modes, depending on the magnitude of the signal at the output transistor M3. One mode, the "buffer mode," may be associated with the "voltage regulation" operating mode of the circuit 100. In this mode, the range-limited buffer transistor M2 allows the error amplifier 110 to regulate the output voltage $V_{out}$. A second mode, the "switch mode," may be associated with the "current-limiting" mode of the circuit 100. In the second mode, the range-limited buffer transistor M2 allows a current in the circuit 100 to be mirrored to the output transistor M3, such that the output transistor current IM3 is limited. It is noted that limiting the output transistor current IM3 may also limit the load current $I_{load}$. For example, the current $I_{M1}$ of mirror transistor M1 is mirrored to the output transistor M3 in the current-limiting mode. Throughout this description, the term mirroring a current is not confined to mean mirroring the exact magnitude of current, but may include mirroring some fraction or multiple of a current to the output transistor M3. The fraction or multiple may be pre-determined by appropriate selection of transistor sizes.

The range-limited buffer transistor M2 acts as a source follower buffer on the output of the error amplifier 110 in the voltage regulation mode of operation. Thus, the error amplifier 110 regulates the output voltage during the voltage regulation mode of operation via a regulation loop including the error amplifier 110, the range-limited buffer transistor M2, the output transistor M3, and output resistors R1 and R2.

As previously mentioned, the circuit 100 has a current that is mirrored to the output transistor M3 during the current limiting mode. The generation of that current will now be discussed. Current source I1 supplies "I" amperes of current. Thus, the current in range-limited buffer transistor M2 is limited to "I" amps by the current source I1. Current source I2 sinks N*I amperes, where "N" is a greater than one. This allows current source I2 to sink all of the current from the drain D2 of the range-limited buffer transistor M2, along with additional current from the drain D1 of mirror transistor M1. This configuration means that mirror transistor M1 will have a source to drain current of I*(N−1) amperes, such that the total current through mirror transistor M1 and range-limited buffer transistor M2 equals the current sunk by current source I2.

The current sources I1 and I2 serve as bias currents. During voltage regulation mode, they bias up range-limited buffer transistor M2 to operate as a source follower. During current limiting mode, they serve to bias mirror transistor M1 so that its drain D1 is at a pre-determined voltage level. The mirror transistor M1 clamps the voltage at the gate G3 of the output transistor M3 in order to limit the output current IM3, which will be discussed in more detail later. The current sources I1 and I2 may be proportional to absolute temperature (PTAT), although this is not required. The current sources I1 and I2 may be constructed with a similar technique such that they behave with similar characteristics.

The operation of circuit 100 will now be examined under the condition in which the load current $I_{load}$ increases. If the load current $I_{load}$ begins to increase, the output of the error amplifier 110 will drop to maintain voltage regulation at the circuit output $V_{out}$. For example, if the output voltage $V_{out}$ drops, this forces down the voltage of the positive input of the error amplifier 110, which in turn causes the output of the error amplifier 110 to drop. As the error amplifier's output drops, the voltage of the source S2 of range-limited buffer transistor M2 drops and pulls the gate G3 of the output transistor M3 lower, allowing the output transistor M3 to source more current.

Continuing with the discussion of the operation of the circuit 100, the drain D2 of range-limited buffer transistor M2 is clamped at a fixed voltage. For example, it is clamped at the supply voltage $V_{dd}$ minus the source to gate voltage $V_{sg1}$ of mirror transistor M1. If the voltage of the gate G2 of the range-limited buffer transistor M2 is forced down to a point such that [Vds2<(Vgs2−Vt2)] by the dropping of the output voltage of the error amplifier 110, the range-limited buffer transistor M2 will operate in its triode region. In triode operation, the range-limited buffer transistor M2 will have a low impedance path between its drain and source terminals. This low impedance path acts to connect M1 and M3 into a current mirror configuration. The circuit 100 is designed such that, at a pre-determined output transistor current level IM3, the range-limited buffer transistor M2 will operate in its triode region. Thus, the source S2 of range-limited buffer transistor M2 is pulled to nearly the same voltage as the drain D2 of the range-limited buffer transistor M2.

When the range-limited buffer transistor M2 operates in triode region, mirror transistor M1 and output transistor M3 form a current mirror. Moreover, the error amplifier 110 is effectively prevented from regulating the voltage output $V_{out}$ when range-limited buffer transistor M2 operates in its triode region. Thus, the output voltage $V_{out}$ is allowed to fall, such that the output current IM3 is prevented from exceeding a safe limit. Even if the output of the error amplifier 110 is extremely low, it will not affect the output transistor M3, because the drain D1 of the mirror transistor M1 clamps the voltage of the gate G3 of the output transistor M3. For example, the voltage of the gate G3 of the output transistor M3 is clamped to Vdd−Vsg1. The output current IM3 is limited according to Equation 1, in which $W_3$ and $L_3$ are the width and length, respectively, of output transistor M3, and $W_1$ and $L_1$ are the width and length, respectively, of mirror transistor M1. The current I(N−1) is the previously discussed current through the mirror transistor M1.

Equation 1:

$$I_{CL} = I(N-1)\left[\frac{\frac{W_3}{L_3}}{\frac{W_1}{L_1}}\right]$$

The operation of the circuit 100 can also be analyzed based on sensing the drain current IM3 of output transistor M3. In order to generate a greater current IM3, the voltage of the gate G3 of the output transistor M3 drops. This forces the voltage at the source S2 of the range-limited buffer transistor M2 down, as they are coupled together. However, the drain D2 of the range-limited buffer transistor M2 is clamped, as previously described. For example, it is clamped at the supply voltage $V_{dd}$ minus the source to gate voltage $V_{sg1}$ of mirror transistor M1. If the voltage of the gate G2 of the range-limited buffer transistor M2 is forced down to a point such that [Vds2<(Vgs2−Vt2)] by the dropping of the output voltage of the error amplifier 110, the range-limited buffer transistor M2 will operate in its triode region. See triode description above (Page 10). When the range-limited buffer transistor M2 is in its triode region it can be thought of as operating as a resistive switch between the drain D1 of the mirror transistor M1 and the gate G3 of the output transistor M3. Thus, some factor of the current in the mirror transistor M1 is mirrored in the output transistor M3, the factor depending on the relative dimensions of the two transistors M1, M3.

In embodiments of the present invention, the mirror transistor M1 and the output transistor M3 are the same type of device. Therefore, they track Well with each other. For example, the effects of process and temperature variations are minimized because the mirror transistor M1 and the output transistor M3 are affected in a similar fashion.

An aspect of the operation of circuit 100 as the supply voltage Vdd is turned on will now be discussed. In particular, a case in which the load is capacitive will be discussed. Embodiments of the present invention will slowly ramp up the output voltage, when the load is capacitive. In contrast, some conventional voltage regulators exhibit an undesirable sharp spike in current when facing a capacitive load when turning on the supply voltage. In embodiments of the present invention, the output current IM3 is limited by the drain current IM1 in mirror transistor M1.

Figure 2:
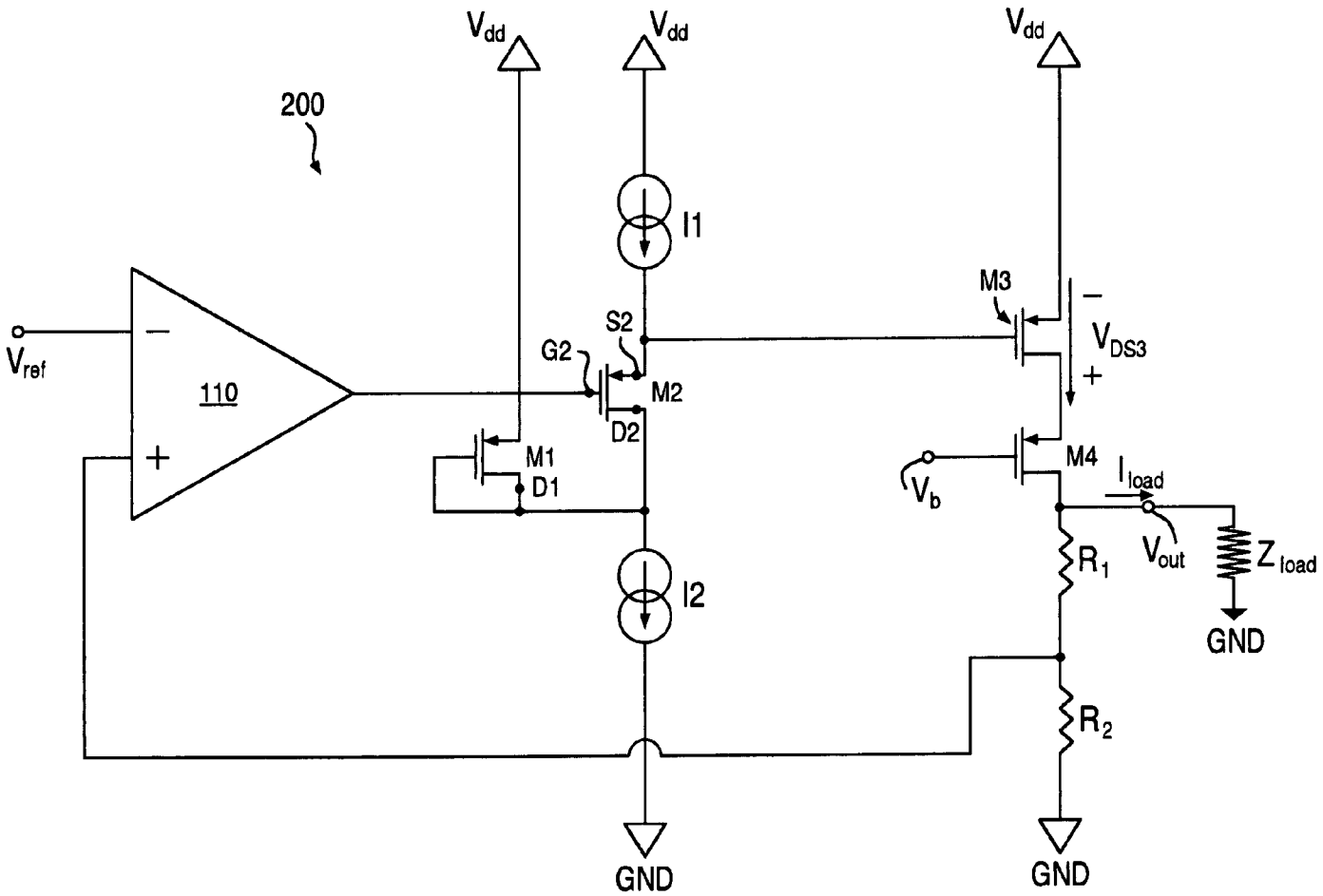
FIG. 2 is a schematic of a circuit for limiting current and regulating voltage using a cascode transistor, according to an embodiment of the present invention.

FIG. 2 is a schematic of a circuit 200 for limiting current in a voltage regulator using a cascode transistor M4, according to an embodiment of the present invention. Various circuit elements in circuit 200 are similar to those in circuit 100 and will not be discussed again. Circuit 200 adds a cascode transistor M4 between output resistor R1 and output transistor M3. This embodiment is used to reduce or eliminate the effect of channel length modulation. To consider the effect of channel length modulation, FIG. 1 will be examined for two arbitrary supply voltages of different magnitudes. For both supply voltages, the drain D3 of output transistor M3 will stay down at $V_{out}$ due to the voltage regulation by the error amplifier 110. However, for the larger of the two supply voltages $V_{dd}$, the drain to source voltage of output transistor M3 will be larger. Thus, M3 will experience channel length modulation. However, mirror transistor M1 will not experience channel length modulation.

In FIG. 2, the bias voltage Vb of the cascode transistor M4 is a predetermined voltage with respect to the supply voltage Vdd. The cascode transistor M4 forces the drain to source voltage Vds3 of the output transistor M3 to be substantially constant, regardless of the supply voltage Vdd. Thus, channel length modulation is reduced or eliminated, in this embodiment of the present invention.

Figure 3:
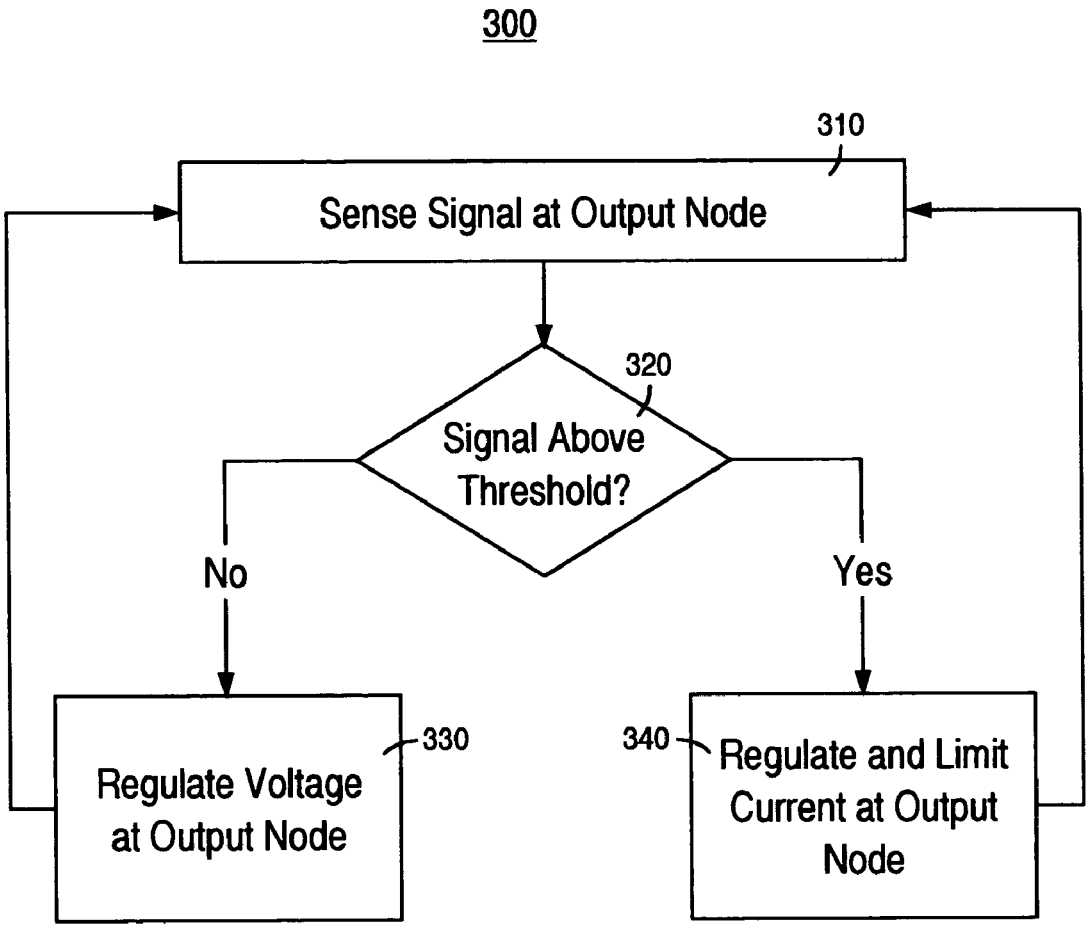
FIG. 3 is a flowchart illustrating steps of a process of limiting current in a voltage regulation circuit, according to embodiment of the present invention.

FIG. 3 is a flowchart illustrating steps of a process 300 of limiting current in a voltage regulation circuit, according to embodiment of the present invention. In step 310, a signal is sensed at an output node.

In step 320, a determination is made as to whether the signal is above or below a pre-determined threshold. The determination may be made by circuitry as illustrated and discussed in FIGS. 1 and 2, although the present embodiment is not so limited.

Step 330 is taken if the signal is below the pre-determined threshold. In step 330, a voltage of the output node is regulated. Step 340 is taken if the signal is above the pre-determined threshold. In step 340, a current at the output node is limited without regulating the voltage at the output node. For example, a regulation component that regulated the output voltage in step 330 is prevented from regulating the voltage at the output node in step 340. Moreover, a device for regulating a current at the output node is allowed to regulate the output current in step 340.

The limiting of the current in step 340 may include limiting a voltage at a control gate of an output transistor to a predetermined level to limit the current at the output node. The limiting of the current in step 340 may also include mirroring a current in a regulation loop to the output node.

While embodiments of the present invention have been described in terms of p-channel devices, n-channel devices may also be used. Moreover, the present invention is not limited to metal oxide field effect devices, for example, bipolar junction devices may also be used. Embodiments of the present invention are compatible with voltage regulators and battery charging systems; however, the present invention is not limited to use in voltage regulators and/or battery charging applications. Embodiments of the present invention are well suited for use as a low-dropout (LDO) voltage regulator.

Therefore, it will be seen that embodiments of the present invention provide current limitation in a voltage regulation circuit. Further, embodiments of the present invention- provide a current limit protection circuit that is compatible with and can be fabricated economically with existing semiconductor fabrication techniques.

The foregoing descriptions of specific embodiments of the present invention have been presented for purposes of illustration and description. They are not intended to be exhaustive or to limit the invention to the precise forms disclosed, and obviously many modifications and variations are possible in light of the above teaching. The embodiments were chosen and described in order to best explain the principles of the invention and its practical application, to thereby enable others skilled in the art to best utilize the invention and various embodiments with various modifications as are suited to the particular use contemplated. It is intended that the scope of the invention be defined by the claims appended hereto and their equivalents.

What is claimed is:

1. A current limiting circuit voltage regulation comprising:

a device coupled to an output node of the current limiting circuit, said device responsive to magnitude of a signal at said output node, wherein said device has a first mode and a second mode depending on the magnitude of the signal;

a regulation component coupled to the device and that regulates a voltage at said output node when said device is in said first mode; and an element coupled to the device and that limits current at said output node when said device is in said second mode, wherein the element that limits current at said output node when said device is in said second mode has a current that is mirrored in an output transistor to limit said current at said output node.

2. The circuit of claim 1, wherein the element that limits current at said output node when said device is in said second mode clamps a voltage at a control gate of an output transistor to limit said current at said output node.

3. The circuit of claim 1, wherein said device is in a feedback loop comprising said regulation component and wherein said feedback loop is broken when said device is in said second mode.

4. The circuit of claim 1, wherein the device acts as a buffer between said regulation component and said output in said first mode.

5. The circuit of claim 1, wherein the device effectively operates as a resistive switch in said second mode.

6. The circuit of claim 1, wherein the device is controlled between said first mode and said second mode by the output of said regulation component.

7. A current limiting voltage regulation circuit comprising:

an output transistor having a control terminal;

an error amplifier having a first input coupled to said output transistor and a second input that can receive a reference voltage;

a first transistor coupled between said control terminal of said output transistor and an output of said error amplifier, said first transistor responsive to magnitude of a signal at said output transistor, wherein said first transistor has a first mode and a second mode depending on the magnitude of the signal, wherein said error amplifier regulates a voltage of said output transistor based on said reference voltage if said first transistor is in said first mode; and a second transistor coupled to said first transistor and said output transistor, wherein a current through said second transistor is mirrored in said output transistor if said first transistor is in said second mode.

8. The circuit of claim 7, wherein said first transistor is in a feedback loop comprising said error amplifier and wherein said feedback loop is broken when said first transistor is in said second mode.

9. The circuit of claim 7, wherein said second transistor clamps a voltage at a control gate of said output transistor if said first transistor is in said second mode.

10. The circuit of claim 7, wherein a drain of said first transistor is clamped at a pre-determined voltage.

11. The circuit of claim 7, wherein said first transistor operates in a triode region in said second mode allowing said second transistor to function as a current mirror with said output transistor.

12. The circuit of claim 7, further comprising a current source feeding said first transistor and a current sink draining said first transistor, wherein substantially the difference between the current sink and source flow through said second transistor.

13. The circuit of claim 7, further comprising a cascode transistor coupled to said output transistor.

14. The circuit of claim 7, wherein said current limiting circuit is a low dropout (LDO) regulation circuit.

15. The circuit of claim 7, wherein said first transistor and said second transistor are coupled by their respective drains.

16. A method of controlling current and regulating voltage, comprising:

a) sensing a signal at an output node;

b) if said signal is below a pre-determined threshold, regulating a voltage at said output node; and c) if said signal is above said pre-determined threshold, limiting a current at said output node without regulating said voltage at said output node, wherein said limiting the current at the output node comprises mirroring a current in a transistor to said output node when said signal is above said pre-determined threshold to limit said current at said output node.

17. The method of claim 16, wherein said c) comprises limiting a voltage at a control gate of an output transistor to a predetermined level to limit said current at said output node.

18. The method of claim 16, wherein said c) comprises preventing a regulation component from regulating said voltage at said output node.

* * * * *